US007236726B2

(12) United States Patent
Mori et al.

(10) Patent No.: US 7,236,726 B2
(45) Date of Patent: Jun. 26, 2007

(54) REUSABLE DEVELOPER CARTRIDGE AND IMAGE FORMING APPARATUS FOR FACILITATING THE REMOVAL OF TONER DURING REFILLING

(75) Inventors: Hiroki Mori, Nagoya (JP); Takahiro Nishimoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/338,721

(22) Filed: Jan. 25, 2006

(65) Prior Publication Data

US 2006/0171743 A1 Aug. 3, 2006

(30) Foreign Application Priority Data

Jan. 31, 2005 (JP) ..... 2005-023050

(51) Int. Cl.
*G03G 15/08* (2006.01)

(52) U.S. Cl. ..... 399/252; 399/258; 399/260; 399/262; 399/263

(58) Field of Classification Search ..... 399/252, 399/119, 120, 258, 260, 262, 263
See application file for complete search history.

(56) References Cited

U.S. PATENT DOCUMENTS 7,163,032 B2 * 1/2007 Itabashi ..... 141/12
2001/0043826 A1 * 11/2001 Mizoguchi et al. ..... 399/359
2004/0134560 A1 * 7/2004 Sato et al. ..... 141/5
2006/0093399 A1 * 5/2006 Okabe et al. ..... 399/111

FOREIGN PATENT DOCUMENTS

JP A 2000-47466 2/2000
JP A 2004-37779 2/2004

* cited by examiner

*Primary Examiner*—David M. Gray
*Assistant Examiner*—Geoffrey T Evans
(74) *Attorney, Agent, or Firm*—Oliff & Berridge, PLC

(57) ABSTRACT

A developer cartridge includes a casing, an agitator, and a developing roller. The casing has a first inner space serving as a developer accommodating chamber that accommodates developer and a second inner space serving as a developing chamber in communication with the developer accommodating chamber. The agitator is disposed in the developer accommodating chamber and has a shaft portion that is rotatably supported in the casing. The agitator is rotatable about the shaft portion. The developing roller is disposed in the developing chamber and is rotatably supported in the casing. The casing is formed with a developer opening located at a position closer to the developing chamber than the shaft portion is.

9 Claims, 7 Drawing Sheets

FRONT
REAR
UPPER
LOWER
1
2
3
4
5
6
7
9
10
10a
10b
12
13
16
17
19
20
21
24
25
26
27
28
34
35
36
37
38
39
40
41
42
44
45
46
53
53A
54
55
56
57
58

REUSABLE DEVELOPER CARTRIDGE AND IMAGE FORMING APPARATUS FOR FACILITATING THE REMOVAL OF TONER DURING REFILLING

CROSS REFERENCE TO RELATED APPLICATIONS

This application claims priority to Japanese Patent Application No. P2005-023050, filed on Jan. 31, 2005, the contents of which are hereby incorporated by reference into the present application.

TECHNICAL FIELD

The present invention relates to a developer cartridge and an image forming apparatus.

BACKGROUND

U.S. Patent Application Publication No. 2004/134560 A1 (corresponding to Japanese Patent Application Publication No. 2004-37779) discloses an electrophotographic-type image forming apparatus that is provided with a developer cartridge detachably mounted on the apparatus main body. The inner space of the case of the developer cartridge is generally divided by a partition wall into a toner accommodating chamber and a developing chamber. In the toner accommodating chamber, toner serving as developer is contained and an agitator for agitating the toner is rotatably provided. A pair of shaft bearing portions that support the shaft portion of the agitator are disposed on both sides of the toner accommodating chamber. A toner filling opening for filling the toner is formed on one side wall of the toner accommodating chamber at the opposite side to the developing chamber with respect to the shaft bearing portions. At the lower portion of the developing chamber, a developing roller that visualizes an electrostatic latent image on a photosensitive member with toner and a supply roller that supplies the toner to the developing roller are provided so as to be rotatable in pressure contact with each other. The bottom wall of the developing chamber is formed in a shape that encircles the developing roller and supply roller so that the toner is smoothly supplied thereto. A small clearance is formed between the bottom wall and outer circumference of the both rollers.

SUMMARY

In recent years, the developer cartridge is reused by refilling a used developer cartridge with new toner after drawing (removing) old and degraded toner from the used cartridge. When drawing the toner, the toner contained in the developer cartridge is drawn (vacuumed out) through the toner filling opening. However, in the conventional developer cartridge, the agitator or partition wall located between the toner filling opening and developing chamber prevents the toner in the developing chamber from being sufficiently drawn. As a result, the used toner may be left in the abovementioned clearance between the developer and supply rollers and the bottom wall of the developing chamber in some cases.

In view of the above-described drawbacks, it is an object of the present invention to provide a developer cartridge and an image forming apparatus capable of efficiently draw the used developer out of the cartridge.

In order to attain the above and other objects, according to one aspect, the present invention provides a developer cartridge. The developer cartridge includes a casing, an agitator, and a developing roller. The casing has a first inner space serving as a developer accommodating chamber that accommodates developer and a second inner space serving as a developing chamber in communication with the developer accommodating chamber. The agitator is disposed in the developer accommodating chamber and has a shaft portion that extends in an axial direction and that is rotatably supported in the casing. The agitator is rotatable about the shaft portion. The developing roller is disposed in the developing chamber and is rotatably supported in the casing. The casing is formed with a developer opening located at a position closer to the developing chamber than the shaft portion is.

According to another aspect, the present invention provides an image forming apparatus. The image forming apparatus includes an apparatus main body and a developer cartridge detachably mounted on the apparatus main body. The developer cartridge includes a casing, an agitator, and a developing roller. The casing has a first inner space serving as a developer accommodating chamber that accommodates developer and a second inner space serving as a developing chamber in communication with the developer accommodating chamber. The agitator is disposed in the developer accommodating chamber and has a shaft portion that extends in an axial direction and that is rotatably supported in the casing. The agitator is rotatable about the shaft portion. The developing roller is disposed in the developing chamber and is rotatably supported in the casing. The casing is formed with a developer opening located at a position closer to the developing chamber than the shaft portion is.

BRIEF DESCRIPTION OF THE DRAWINGS

The above and other objects, features and advantages of the invention will become more apparent from reading the following description of the embodiments taken in connection with the accompanying drawings in which.

DETAILED DESCRIPTION OF THE EMBODIMENTS

A developer cartridge and image forming apparatus according to an embodiment of the present invention will be described while referring to FIGS. 1 to 7B.

In the following description, the expressions "front", "rear", "upper", "lower", "right", and "left" are used to define the various parts when the image forming apparatus is disposed in an orientation in which it is intended to be used.

1. Entire Configuration of a Laser Printer

Figure 1:
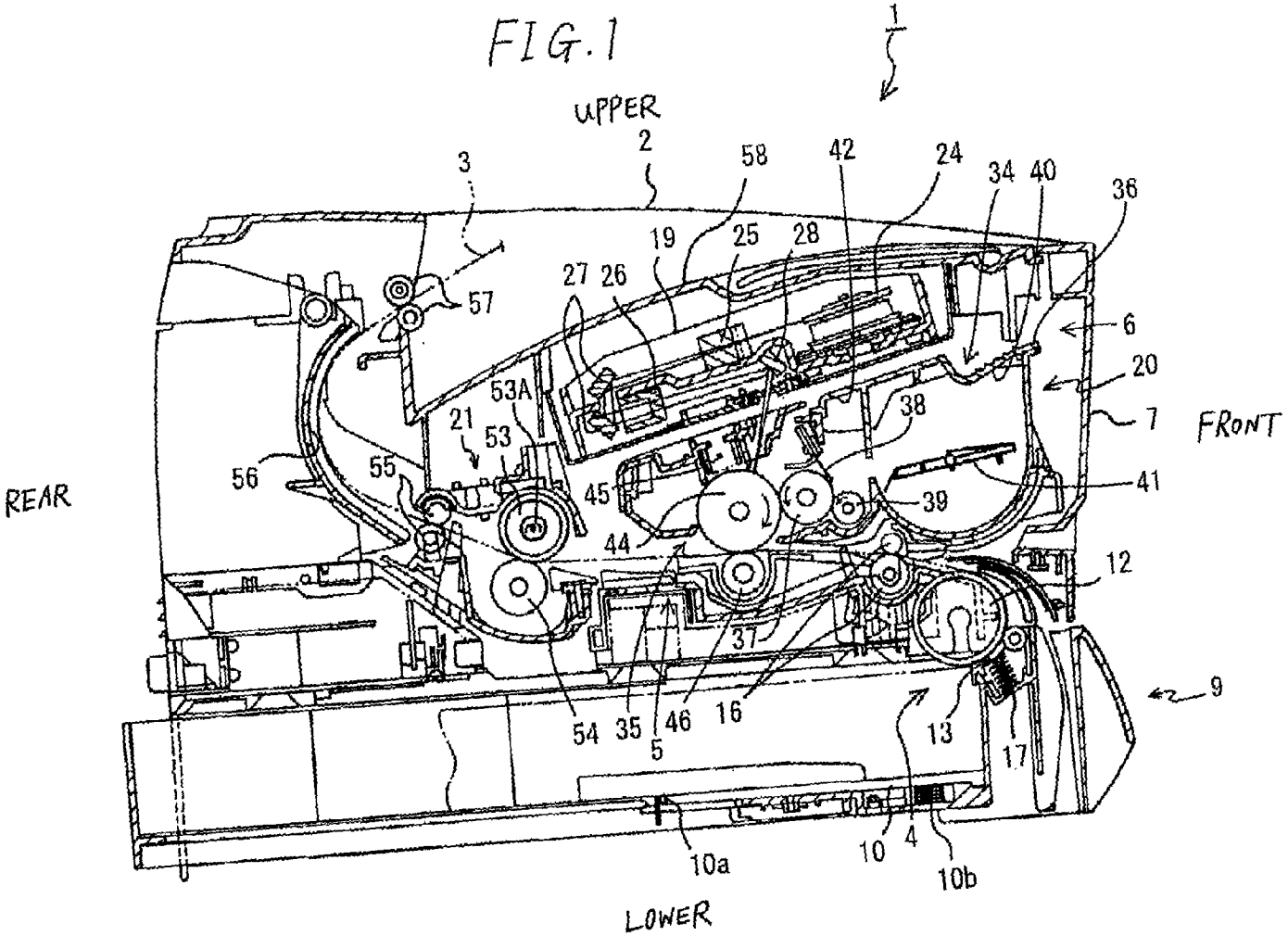
FIG. 1 is a cross-sectional view showing relevant parts of a laser printer according to an embodiment of the present invention.

FIG. 1 shows a laser printer 1 according to the embodiment. Hereinafter, the right side of FIG. 1 is assumed to be the front side and the left side thereof is assumed to be the rear side. The laser printer 1 includes a main body casing 2, a feeder portion 4 for feeding a paper sheet 3 serving as a sheet material to be contained in the main body casing 2, an image forming section 5 for forming an image onto the fed paper sheet 3, and the like.

(1) Main Body Casing

On the front surface of the main body casing, a mount opening 6 for detachably mounting a process cartridge 20 and a front cover 7 that opens and shuts over the mount opening 6 is formed. The front cover 7 is pivotally supported by a cover shaft (not shown) provided at the lower end portion thereof. When the front cover 7 is closed about the cover shaft, the mount opening 6 is closed by the front cover 7, as shown in FIG. 1; whereas when the front cover 7 is opened (tilted down) using the cover shaft as fulcrum, the mount opening 6 is opened and thereby the process cartridge 20 can be mounted and removed through the mount opening 6 to/from the main body casing 2.

(2) Feeder Portion

The feeder portion 4 includes a sheet feed cassette 9, a sheet press plate 10 provided in the sheet feed cassette 9, a sheet feed roller 12 and a separation pad 13 provided at the upper front portion of the sheet feed cassette 9, and a pair of registration rollers 16 provided on the downstream side in the conveying direction of the paper sheet 3 relative to the sheet feed roller 12.

The sheet feed cassette 9 is detachably mounted on the bottom portion of the main body casing 2. The paper sheets 3 are stacked in the sheet feed cassette 9. The sheet feed cassette 9 is pulled out in the front side (right side in FIG. 1) direction of the printer 1 when the sheet feed cassette 9 is replenished with paper sheets 3.

The sheet press plate 10 can hold the stacked paper sheets 3. A supporting shaft 10*a* provided at the far end of the sheet press plate 10 relative to the sheet feed roller 12 axially supports the bottom surface of the sheet feed cassette 9. The near end (relative to the sheet feed roller 12) of the sheet press plate 10 can pivotally be moved about the supporting shaft 10*a* in the vertical direction. Further, the sheet press plate 10 is urged by a spring 10*b* from the backside thereof in the upward direction. Accordingly, as the stacked amount of the paper sheets 3 increases, the sheet press plate 10 swings in the downward direction about the supporting shaft 10*a* against the urging force of the spring 10*b*.

The separation pad 13 is provided at the position facing the sheet feed roller 12 and is urged by a spring 17 provided on the backside thereof in the direction toward the sheet feed roller 12.

The uppermost paper sheet 3 in paper sheets stacked on the sheet press plate 10 of the sheet feed cassette 9 is pressed to the sheet feed roller 12 by the urging force of the spring 10*b*. When printing operation is started, the paper sheets 3 are sequentially fed by the rotating sheet feed roller 12 and separated from each other when being sandwiched between the sheet feed roller 12 and separation pad 13. The separated paper sheet 3 is fed to the registration rollers 16.

After registration, the registration rollers 16 feed the paper sheet 3 to the position between the photosensitive drum 44 and a transfer roller 46, which is the transfer position at which a toner image on the photosensitive drum 44 is transferred onto the paper sheet 3.

(3) Image Forming Section

The image forming section 5 includes a scanner unit 19, a process cartridge 20, a fixing section 21, and the like.

(a) Scanner Unit

The scanner unit 19 is provided at the upper portion in the main body casing 2 and includes a laser light emission section (not shown), a polygon mirror 24 to be rotatably driven, lenses 25, 26, reflecting mirrors 27, 28, and the like. In the scanner unit 19, a laser beam based on predetermined image data which is emitted from the laser light emission section is passed through or reflected by the polygon mirror 24, lens 25, reflecting mirror 27, lens 26, and reflecting mirror 28 in the order mentioned and irradiates the surface of the photosensitive drum 44 in the process cartridge 20 in high speed scanning.

(b) Process Cartridge

The process cartridge 20 includes a developer cartridge 34 and a drum cartridge 35.

The developer cartridge 34 is detachably mounted to the drum cartridge 35. The developer cartridge 34 has a box-type toner case 36 (see in addition FIG. 4) that opens toward the rear. Formed at the front portion of the toner case 36 is a toner accommodating chamber 40 to be filled with toner which is development powder. In the toner accommodating chamber 40, an agitator 41 for agitating the toner is provided so as to be rotated. A developing chamber 42 is formed at the rear portion in the toner case 36. A developing roller 37, a thickness regulating blade 38, and a supply roller 39 are provided in the developing chamber 42.

The developing roller 37 is disposed in confrontation with the photosensitive drum 44 and is rotatably supported by the toner case 36. The developing roller 37 is composed of a metal roller shaft coated with a conductive rubber material. A developing bias is applied to the developing roller 37.

The supply roller 39 is disposed on the front side of the developing roller 37. More specifically, the supply roller 39 is rotatably disposed at the opposite position of the photosensitive drum 44 with the developing roller 37 interposed therebetween. The supply roller 39 is in pressure contact with the developing roller 37. The supply roller 39 is composed of a metal roller shaft coated with a conductive foaming material and gives frictional charge to the toner to be supplied to the developing roller 37.

The thickness regulating blade 38 is provided near the developing roller 37. The thickness regulating blade 38 is composed of a blade main body 38A made of a metal leaf spring, at a tip of which is provided with a pressing portion 38B having a semicircular cross section made of insulating silicone rubber. The thickness regulating blade 38 is supported by the developer cartridge 34, near the developing roller 37. The pressing portion 38B is pressed against the developing roller 37 by the elastic force of the blade body 38A.

Upon rotation of the supply roller 39, the toner discharged from the toner accommodating chamber 40 is supplied to the developing roller 37. At this time, the toner is positively charged by friction between the supply roller 39 and the developing roller 37. The toner supplied to the developer roller 37 is further advanced, along with the rotation of the developing roller 37, between the pressing portion 38B of the thickness regulating blade 38 and the developing roller 37, where the toner is further charged by sufficient friction.

The toner is then borne onto the developing roller 37 as a thin layer having a uniform thickness.

The drum cartridge 35 includes, as shown in FIG. 1, a photosensitive drum 44, a scorotron charger 45, a transfer roller 46, and the like.

The photosensitive drum 44 has a cylindrical shape and is composed of a metal drum shaft coated with a drum body whose outermost surface is formed from a positively charged photosensitive layer including polycarbonate. The photosensitive drum 44 is provided so as to be rotated in a clockwise direction about the drum shaft that is supported in the left-to-right direction.

The scorotron charger 45 is disposed opposite to the photosensitive drum 44 at the portion above the photosensitive drum 44, spaced away by a predetermined interval therefrom, so as not to be in contact therewith. The scorotron charger 45 generates a corona discharge from a discharging wire such as tungsten to thereby positively charge a surface of the photosensitive drum 44 in a uniform manner.

The transfer roller 46 is rotatably supported below the photosensitive drum 44 in confrontation with the photosensitive drum 44. The transfer roller 46 is composed of a metal roller shaft coated with an ion-conductive rubber material. At the time of the transfer, a predetermined transfer bias (transfer forward bias) is applied to the photosensitive drum 44.

After positively and uniformly charging the surface of the photosensitive drum 44 using the scorotron charger 45 by rotation of the photosensitive drum 44, high speed laser scanning is performed by the scanner unit 19 according to externally input image data to expose the surface of the photosensitive drum 44 to form an electrostatic latent image thereon based on the predetermined image data.

Upon rotation of the developing roller 37, the positively charged toner borne on the developing roller 37 is brought into contact with the photosensitive drum 44. At this time, the toner is supplied to the electrostatic latent image formed on the surface of the photosensitive drum 44, that is, the exposed part of the surface of the photosensitive drum 44 positively charged in a uniform manner, where an electric potential is lowered by having been exposed to the laser beam. The toner selectively borne on the photosensitive drum 44 becomes a visual image, and thus reverse developing is achieved.

Thereafter, a predetermined transfer bias is applied to the photosensitive drum 44. Accordingly, the toner image borne on the surface of the photosensitive drum 44 is transferred onto the paper sheet 3 while the paper sheet 3 is fed, by the registration rollers 16, between the photosensitive drum 44 and the transfer roller 46. The paper sheet 3 on which the toner image has been transferred is then conveyed to the fixing section 21.

(c) Fixing Section

The fixing section 21 is disposed on the rear side of the process cartridge 20. The fixing section 21 includes a heating roller 53, a press roller 54 and a pair of conveyer rollers 55 provided downstream of the rollers 53 and 54. The heating roller 53 has a halogen lamp 53A for heating inside a metallic tubular roller. The toner transferred onto the paper sheet 3 in the process cartridge 20 is heat fixed while the paper sheet 3 passes between the heating roller 53 and the press roller 54. The paper sheet 3 is then fed to a sheet discharge path 56 by the conveyer rollers 55. The paper sheet 3 fed to the sheet discharge path 56 is further conveyed to a pair of sheet discharge rollers 57 provided at the top end portion of the sheet discharge path 56 to be discharged onto a sheet discharge tray 58 formed on the upper surface of the main body casing 2.

2. Detailed Configuration of Developer Cartridge

The configuration of the developer cartridge will be described in greater detail.

The toner case 36 has an elongated box shape extending in the left-to-right direction. The toner case 36 includes: a case main body 36A having an opening formed in a part of its rear end and a part of its upper end; and a cover 36B which is assembled to the case main body 36A in such a manner as to close the opening of the upper end thereof. A lower partition wall 61 is formed in the case main body 36A. The lower partition wall 61 protrudes upward in such a manner as to have a mountain-like cross section. A plate-like upper partition wall 62 is formed in the cover 36B. The upper partition wall 62 protrudes downward in such a manner that the leading end thereof faces the leading end of the lower partition wall 61. The inner space of the toner case 36 is divided by the both partition walls 61 and 62 into front and rear sections: the front section is the toner accommodating chamber 40 and the rear section is the developing chamber 42. An elongated communication opening 63 extends in the left-to-right direction between a lower opening edge 61A formed at the upper end of the lower partition wall 61 and an upper opening edge 62A formed at the lower end of the upper partition wall 62. The toner accommodating chamber 40 and developing chamber 42 are in communication with each other through the communication opening 63. The width of the communication opening 63 in the left-to-right direction corresponds to the width of the developing chamber 42. The width of the toner accommodating chamber 40 is larger than the width of the communication opening 63 by a length corresponding to a concave portion 71 (to be described later) formed on the inner surface of the toner accommodating chamber 40.

In the developing chamber 42, the supply roller 39 is provided on the lower rear side of the communication opening 63. Further, the developing roller 37, which is provided on the lower rear side of the communication opening 63, is located on the upper rear side of the supply roller 39. The case main body 36A has a bottom wall 64 that covers the bottom portion of the developing chamber 42. The bottom wall 64 is formed in a shape that encircles the lower surface sides of the outer circumferences of the supply roller 39 and developing roller 37. A small gap S is formed between the bottom wall 64 and outer circumferences of the supply roller 39 and developing roller 37.

Figure 2:
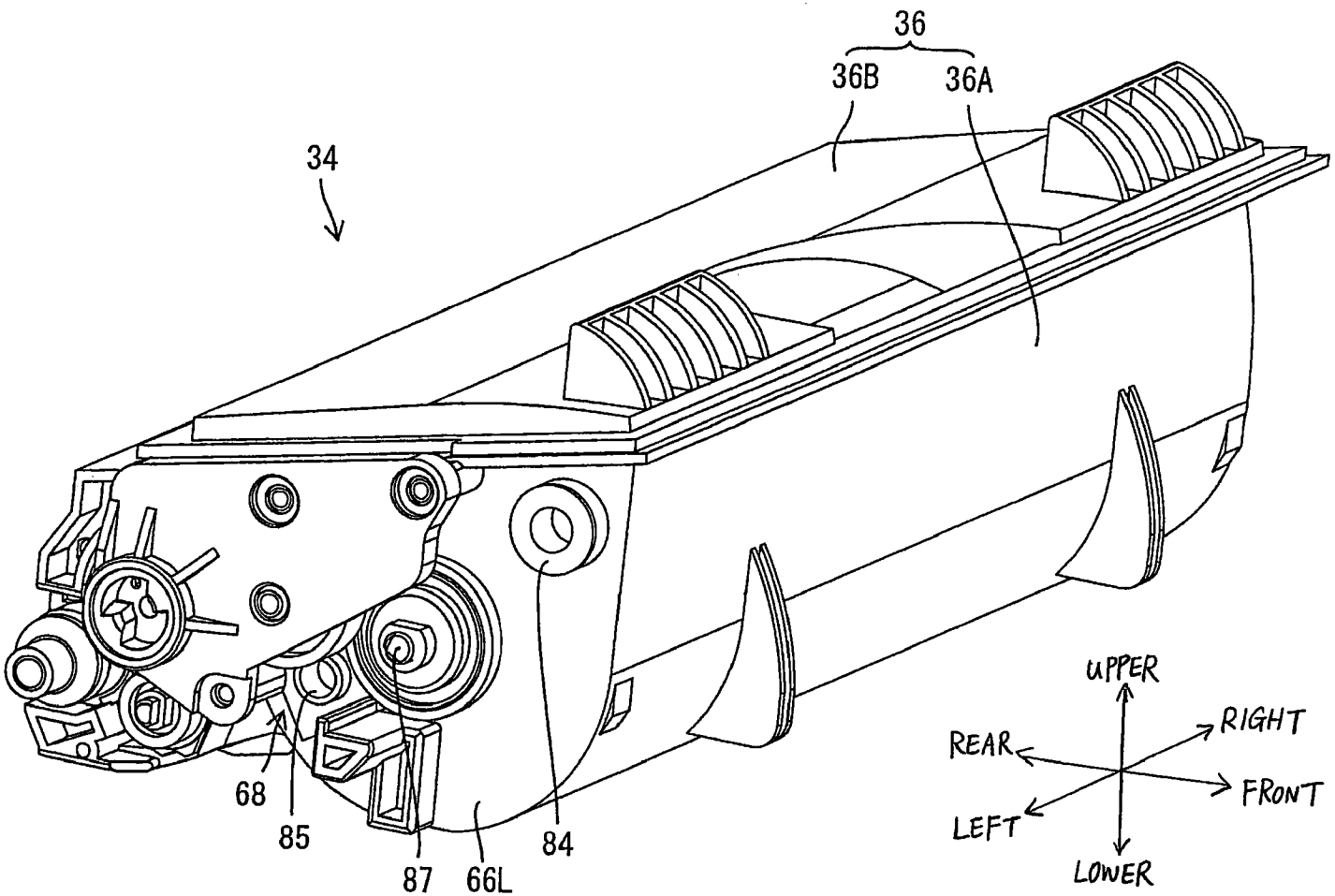
FIG. 2 is a perspective view of a developer cartridge according to the embodiment as viewed from the upper left.
Figure 3:
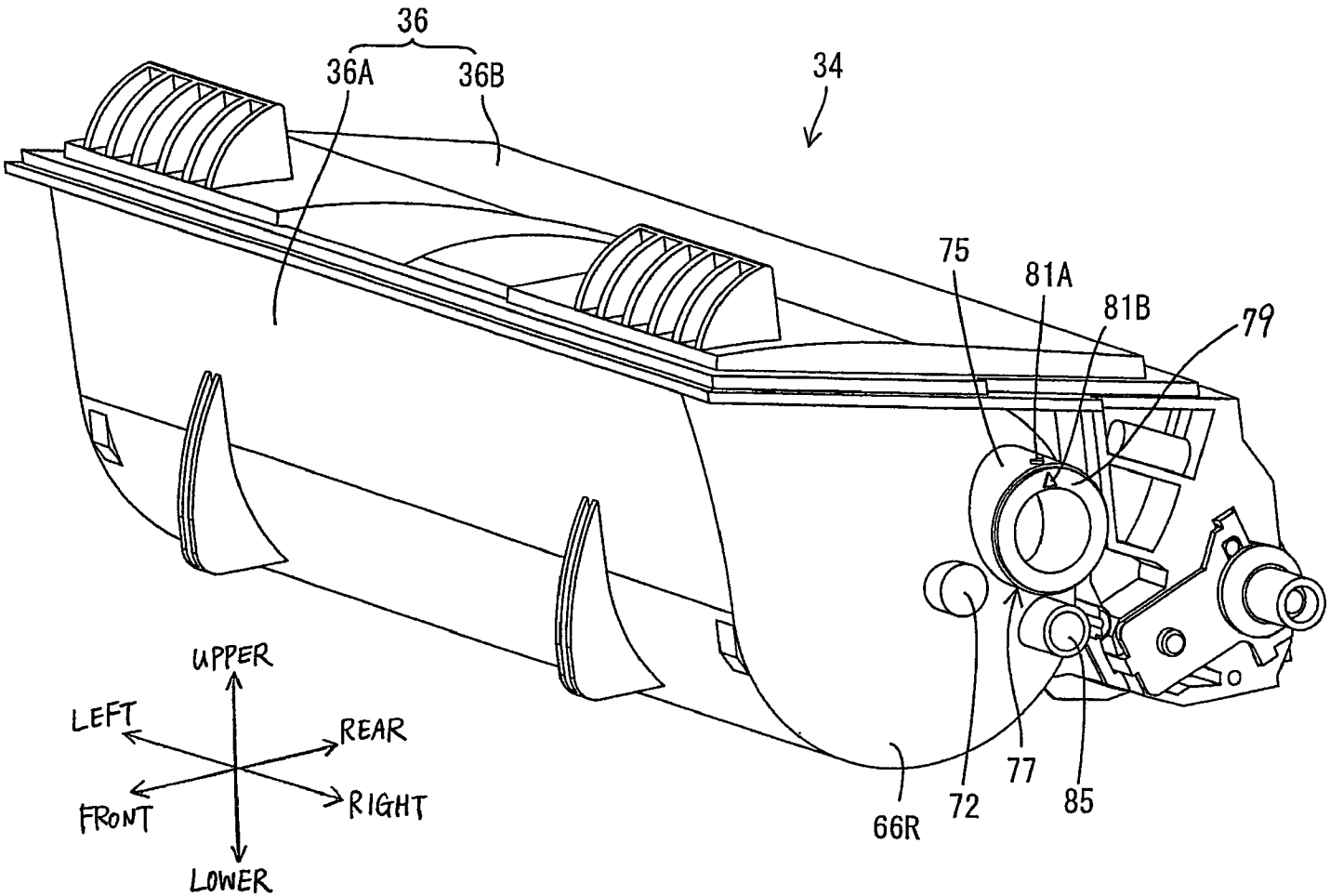
FIG. 3 is a perspective view of the developer cartridge as viewed from the upper right.
Figure 6:
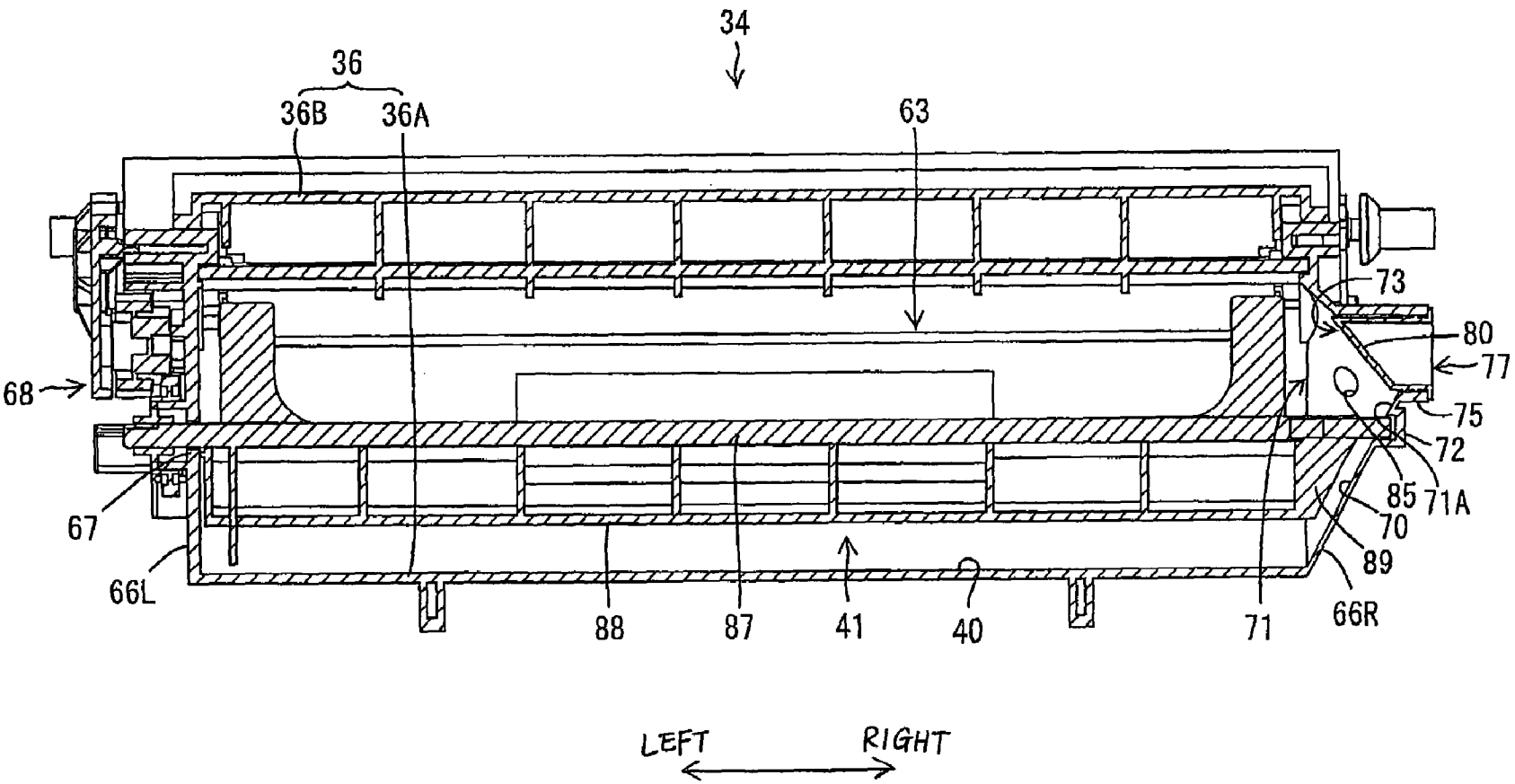
FIG. 6 is a cross-sectional view taken along a line VI-VI in FIG. 4.

As shown in FIGS. 2, 3, and 6, the toner case 36 has a pair of side walls 66L and 66R that covers the left and right end sides of the toner accommodating chamber 40. As shown in FIG. 6, the inner surface of the left side wall 66L is flattened. At the portion near the center of the left side wall 66L, a shaft bearing portion 67 that rotatably supports an agitator 41 (to be described later) with a shaft portion 87 of the agitator 41 inserted thereinto. Provided on the outer surface of the side wall 66L is a gear mechanism 68 for transmitting motive energy from a motor (not shown) provided in the main body casing 2 to the rotary shafts of the developing roller 37, supply roller 39, and agitator 41 to thereby rotatingly drive the rollers and agitator.

As shown in FIG. 6, an inclined surface 70 having a substantially cone shape is provided on nearly the entire inner surface of the right side wall 66R. The inclined surface 70 defines a cone-like concave portion 71. Adjacently provided at the bottom portion 71A (the portion near the peak of the cone) of the concave portion 71 are a shaft bearing portion 72 that supports the shaft portion 87 of the agitator 41 and a toner opening 73 for drawing the used toner from the toner accommodating chamber 40 and the developing chamber 42 and for filling the toner accommodating chamber 40 with new toner. The shaft bearing portion 72 has a bottomed cylindrical shape. One end portion of the shaft portion 87 is engaged with the inside of the shaft bearing portion 72, allowing the shaft portion 87 of the agitator 41 to be rotatably supported. Note that, when drawing the toner, the toner in the toner accommodating chamber 40 and the developing chamber 42 is drawn (sucked) through the toner opening 73 by a suction force produced by an external vacuum device (not shown).

Figure 4:
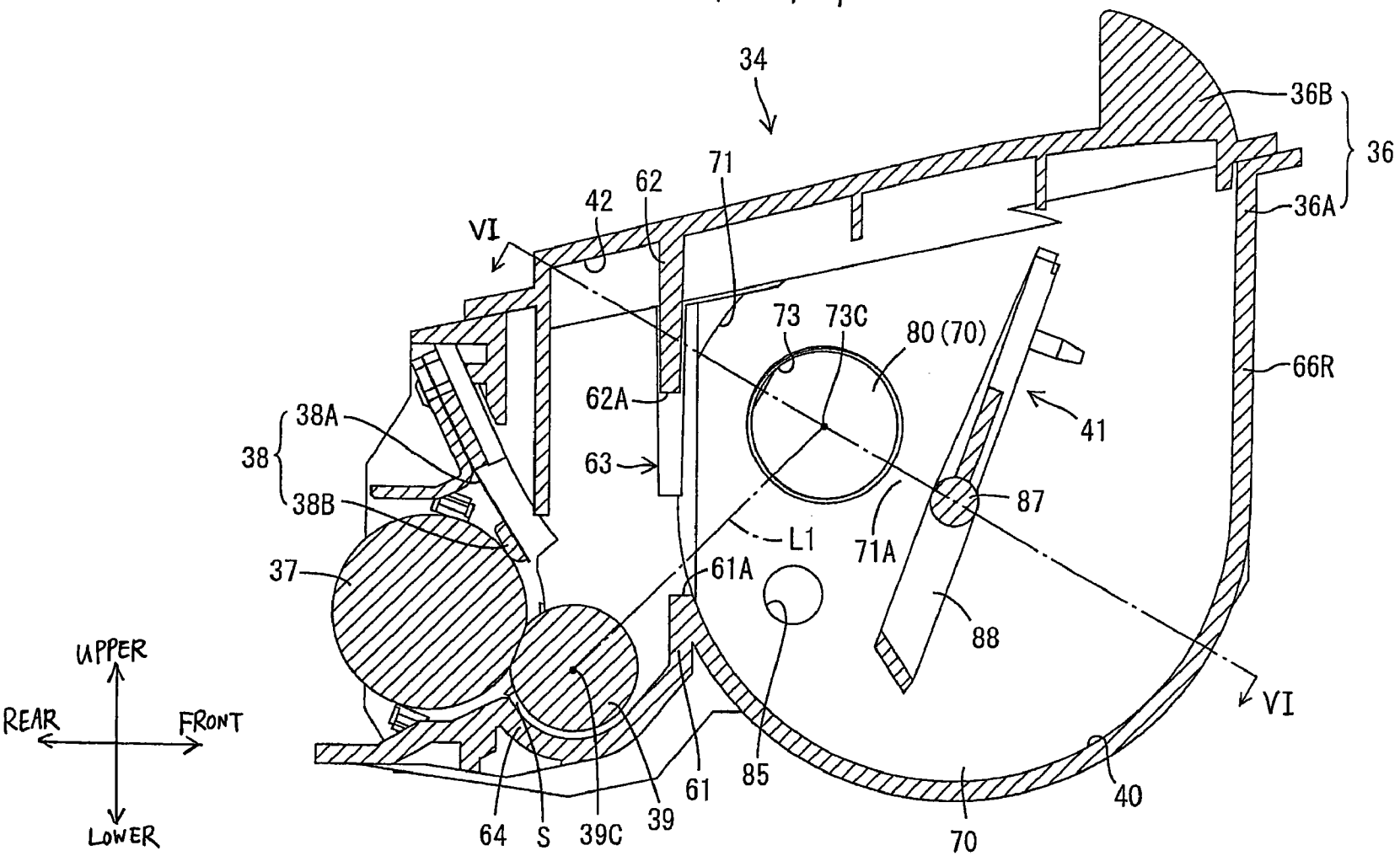
FIG. 4 is a vertical cross-sectional view of the developer cartridge as viewed from the left.

The toner opening 73, which has a circular shape as viewed from the left-to-right direction, is opened toward the inside of the side wall 66R. As shown in FIG. 6, the inclined surface 70 tapers toward the toner opening 73 (to the right direction). As shown in FIG. 4, the toner opening 73 is disposed at the obliquely upper rear of the shaft bearing portion 72 in the toner accommodating chamber 40 and, more specifically, the distance between the toner opening 73 and developing chamber 42 is smaller than the distance between the shaft bearing portion 72 (shaft portion 87 of the agitator 41) and developing chamber 42. Further, the distances between the toner opening 73 and supply roller 39, developing roller 37, partition walls 61, 62, communication opening 63 is smaller than the distances between the shaft bearing portion 72 (shaft portion 87 of the agitator 41) and the above respective components. Further, the communication opening 63 is located on a plane L1 passing through a center 73C (center position of the opening edge on the inner surface side of the side wall 66R) of the toner opening 73 and a center axis 39C of the supply roller 39. That is, the lower opening edge 61A of the lower partition wall 61 is disposed below the plane L1, and the upper opening edge 62A of the upper partition wall 62 is disposed above the plane L1. In other words, there is no component such as the partition walls 61 and 62 in the area between the center 73C of the toner opening 73 and the center axis 39C of the supply roller 39.

Figure 7A:
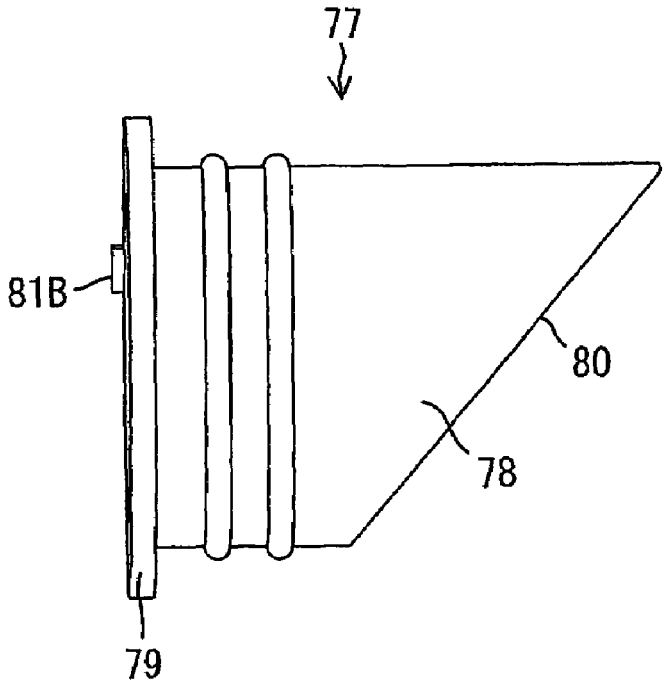
FIG. 7A is a side view of a cap member used in the developer cartridge according to the embodiment.
Figure 7B:
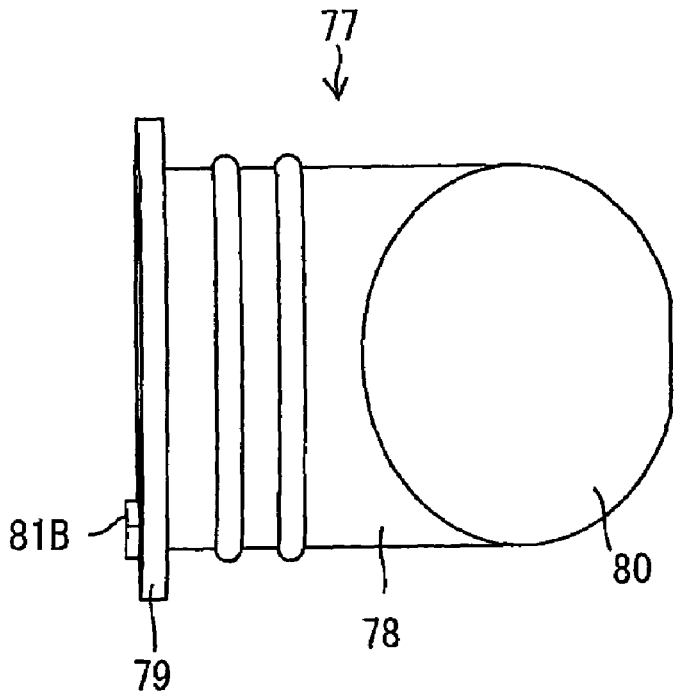
FIG. 7B is a bottom view of the cap member shown in FIG. 7A.

As shown in FIGS. 3 and 6, provided on the outer surface of the right side surface 66R is a cap attachment portion 75 that cylindrically protrudes from the hole edge portion of the toner opening 73. A cap member 77 that closes the toner opening 73 is detachably attached to the inside of the cap attachment portion 75. As shown in FIGS. 7A and 7B, the cap member 77 has a cylindrical portion 78 to be fitted in the cap attachment portion 75. A flange portion 79 extending outward in the radial direction of the cylindrical portion 78 is formed at one end of the cylindrical portion 78. When the cap member 77 is attached to the cap attachment portion 75, the engagement between the flange portion 79 and the end portion of the cap attachment portion 75 defines the position of the cap member 77 in the axial direction (direction that the cap member 77 is inserted into the cap attachment portion 75). The end portion opposite to the flange portion 79 of the cylindrical portion 78 is closed by an inclined portion 80. The inclined portion 80 inclines so as to follow the inclined surface 70 of the side wall 66R. Further, as shown in FIG. 3, triangle markers 81A and 81B (an attachment orientation identification portion) are provided on the outer circumferential surface of the cap attachment portion 75 and the outer surface of the flange portion 79. When the cap member 77 is inserted with the both markers 81A and 81B aligned with each other, the insertion of the cap member 77 can be correctly made in terms of the orientation around the axis.

Figure 5:
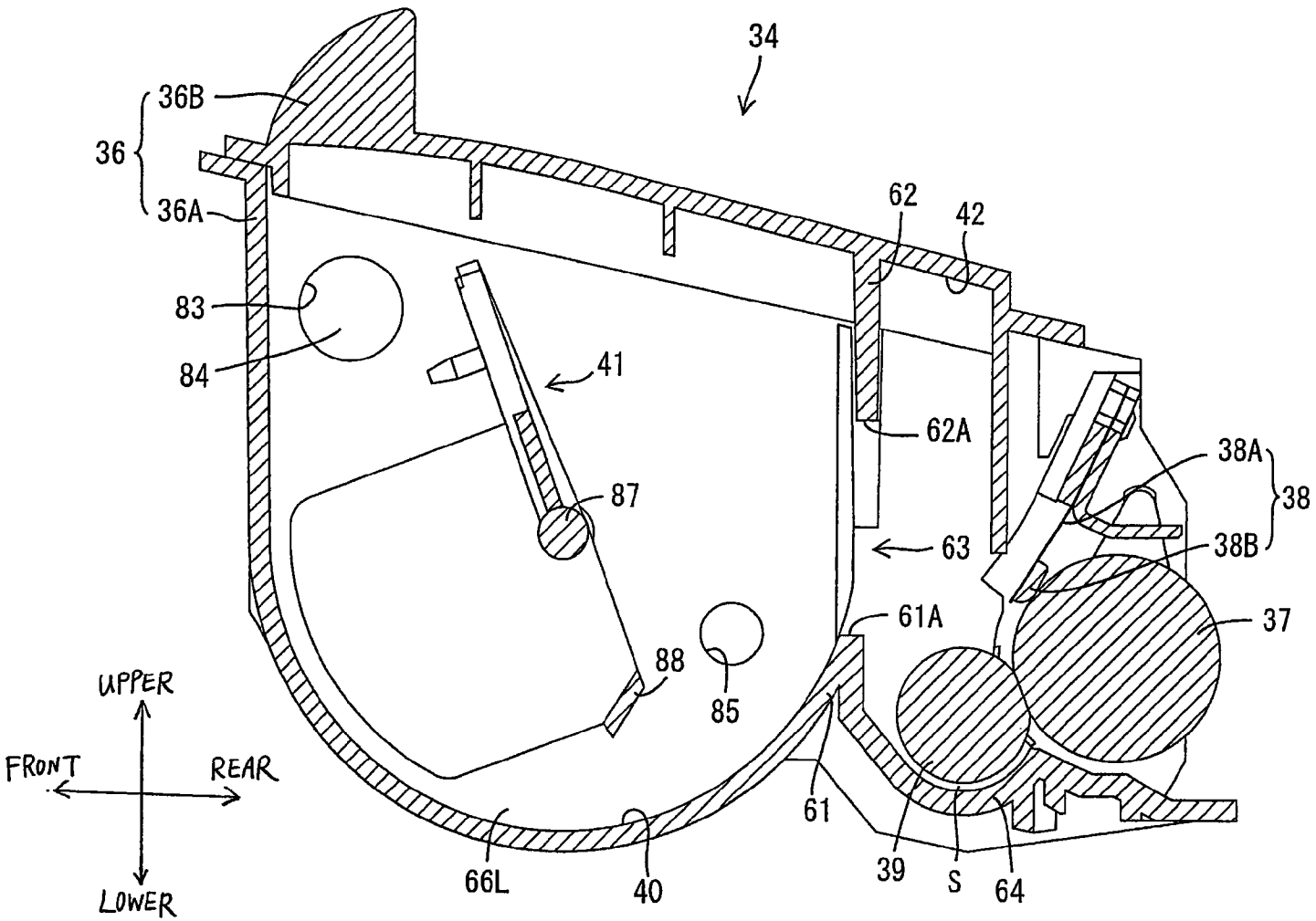
FIG. 5 is a vertical cross-sectional view of the developer cartridge as viewed from the right.

As shown in FIG. 5, a circular air hole 83 having a smaller diameter than the diameter of the toner opening 73 is formed in the left side wall 66L. The air hole 83 is closed by a closure member 84 to be detachably attached to the outer surface of the side wall 66L. During the toner drawing operation, the closure member 84 is removed together with the cap member 77 to allow the outside air to flow in through the air hole 83 when the toner is vacuumed through the toner opening 73. Further, window holes 85 for detecting residual toner quantity are provided in the both side walls 66L and 66R, respectively.

The agitator 41 has the shaft portion 87 having a round bar shape. As described above, the shaft portion 87 is supported by the shaft bearing portions 67 and 72 provided in the both side walls 66L and 66R in a posture that extends in the left-to-right direction, allowing the agitator 41 to be rotated about the shaft portion 87. Further, the agitator 41 has a support portion 88 that extends outward in the radial direction thereof. A film-like agitation member (not shown) made of polyethylene terephthalate is attached to the tip end of the support portion 88. The agitation member extends nearly from the left side wall 66L to the right side wall 66R (except in the area within the concave portion 71). The rotation of the shaft portion 87 rotates the agitator 41 in the toner accommodating chamber 40 to agitate the toner in the toner accommodating chamber 40. At the same time, the agitation member slidably contacts the cylindrical-shaped bottom surface of the toner accommodating chamber 40 in a bending state to push up the toner. As a result, the pushed up toner is discharged to the developing chamber 42 through the communication opening 63. Further, a concave-portion agitating portion 89 (FIG. 6) is formed at the right end of the agitator 41. The concave-portion agitating portion 89 extends outward in the radial direction from the shaft portion 87 and has a triangle plate shape that conforms to the inclined surface 70. Upon rotation of the shaft portion 87, the concave-portion agitating portion 89 agitates the toner in the concave portion 71 without contacting the inclined surface 70.

3. Effects

With the developer cartridge 34 and the laser printer 1 according to the above-described embodiment, the toner opening 73 is located closer to the developing chamber 42 than the shaft portion 87 of the agitator 41 is. Therefore, the agitator 41 is less likely to prevent the toner drawing operation. As a result, even the toner in the developing chamber 42, such as the toner that has entered the gap S formed between the developing roller 37 and toner case 36, can be efficiently drawn and collected.

Further, by providing the supply roller 39 for supplying the toner to the developing roller 37 in the developing chamber 42, the toner can smoothly be supplied to the developing roller 37. Further, the toner that has entered the gap S between the developing roller 37, supply roller 39 and the toner case 36 can be efficiently drawn and collected.

Further, the communication opening 63 is formed on the plane L1 passing through the center 73C of the toner opening 73 and center axis 39C of the supply roller 39. With this configuration, the area between the toner opening 73 and the center axis 39C of the supply roller 39 can be prevented from being blocked by the partition walls 61 and 62, allowing the toner around the supply roller 39 to be easily drawn and collected.

Further, the inclined surface 70 that tapers toward the toner opening 73 is provided at the periphery of the toner opening 73. With this configuration, the development powder around the toner opening 73 can be drawn more easily than in the case where the surface around the toner opening 73 is flattened. More specifically, this configuration makes it less likely for the toner to be left in the corner formed by the side wall 66R in which the inclined surface 70 is provided and other walls (upper wall, front wall, lower wall of the toner accommodating chamber 40, and partition walls 61 and 62) other than the side walls 66L and 66R of the toner accommodating chamber 40.

Further, the shape of the inner surface of the cap member 77 conforms to the inclined surface 70. With this configuration, it can be prevented that the cap member 77 impedes the toner agitation operation of the agitator 41.

Further, the markers 81A and 81B for identifying the attachment orientation of the cap member 77 with respect to the toner opening 73 are provided on the area between the cap member 77 and toner case 36. With this configuration, it can be prevented that the cap member 77 is inserted into the attachment portion 75 in a wrong orientation.

Further, the toner opening 73 is provided in one of the both side walls 66L and 66R. This configuration is less likely to prevent the toner supply function to the developing chamber 42 performed by the rotation of the agitator 41, compared with the case where the toner opening 73 is formed in the wall other than the side walls 66L and 66R.

Further, the toner opening 73 and shaft bearing portion 72 are adjacently disposed at the bottom portion 71A of the concave portion 71 formed in the one side wall 66R, and the toner in the concave portion 71 is agitated by the concave-portion agitating portion 89. With this configuration, the toner in the toner accommodating chamber 40 can be sufficiently agitated.

Further, the gear mechanism 68 is provided in the side wall 66L located at the opposite side to the side wall 66R in which the toner opening 73 is provided. With this configuration, flexibility in designing the layout of the gear mechanism 68 and toner opening 73 can be increased. Further, the gear mechanism 68 can be prevented from being sprinkled with the toner during the toner drawing operation.

Further, the air hole 83 is provided in the side wall 66L located at the opposite side to the side wall 66R in which the toner opening 73 is provided. With this configuration, the toner in the toner case 36 can quickly be drawn and collected.

While the invention has been described in detail with reference to the specific embodiment thereof, it would be apparent to those skilled in the art that various changes and modifications may be made therein without departing from the spirit of the invention.

(1) For example, in the above-described embodiment, the developer cartridge 34 includes the developing roller 37 and the supply roller 39. However, a developer cartridge may not include a supply roller.

(2) In the above-described embodiment, the toner opening 73 also functions as a toner replenishment opening (toner filling opening) for filling toner into the toner accommodating chamber 40. However, toner replenishment operation can be performed through an opening other than the toner opening 73.

(3) In the above-described embodiment, the markers 81A and 81B as the attachment orientation identification portion are provided on the toner case 36 and the cap member 77. However, the shape of the cap member may be made trapezoidal or the like and the shape of the cap attachment portion may be correspondingly formed in order to prevent the cap member from being inserted in a wrong orientation.

What is claimed is:

1. A developer cartridge comprising:

a casing having a first inner space serving as a developer accommodating chamber that accommodates a developer and a second inner space serving as a developing chamber in communication with the developer accommodating chamber;

an agitator disposed in the developer accommodating chamber and having a shaft portion that extends in an axial direction and that is rotatably supported in the casing, the agitator being rotatable about the shaft portion;

a developing roller disposed in the developing chamber and rotatably supported in the casing, wherein the casing is formed with a developer opening located at a position closer to the developing chamber than the shaft portion is, the casing including a pair of side walls that have shaft bearing portions for supporting both axial ends of the shaft portion, wherein the developer opening is formed in one of the pair of side walls, and a gear mechanism that transmits a driving force to the developing roller and the agitator is disposed on an outer surface of an other of the pair of side walls, located opposite to the one of the pair of side walls in which the developer opening is formed.

2. The developer cartridge according to claim 1, further comprising a supply roller disposed in the developing chamber and rotatable about a rotational axis of the supply roller for supplying the developer to the developing roller.

3. The developer cartridge according to claim 2, wherein the casing includes a partition wall that divides an inner space inside the casing into the first inner space serving as the developer accommodating chamber and the second inner space serving as the developing chamber;

wherein the partition wall is formed with a communication opening that allows the communication between the developer accommodating chamber and the developing chamber; and wherein the communication opening is positioned on a plane passing through a center of the developer opening and the rotational axis of the supply roller.

4. The developer cartridge according to claim 1, wherein the casing includes the side wall located on an axial end of the casing, the side wall having an inner surface that faces the developer accommodating chamber;

wherein the inner surface includes an inclined surface formed at a periphery of the developer opening; and wherein the inclined surface tapers toward the developer opening.

5. The developer cartridge according to claim 4, further comprising a cap member that is detachably attached to the casing for closing the developer opening, wherein the cap member has an inner surface having a shape conforming to the inclined surface.

6. The developer cartridge according to claim 5, wherein the cap member and the casing have an attachment orientation identification portion for identifying an orientation of the cap member with respect to the developer opening.

7. The developer cartridge according to claim 4, wherein one of the pair of side walls has the inner surface;

wherein the inclined surface defines a concave portion having a bottom portion;

wherein the developer opening and the shaft bearing portions are adjacently positioned at the bottom portion; and wherein the agitator includes a concave-portion agitating portion extending toward inside the concave portion.

8. The developer cartridge according to claim 1, wherein an air hole is formed in the other side wall located opposite to the side wall in which the developer opening is formed.

9. An image forming apparatus comprising:

an apparatus main body; and a developer cartridge detachably mounted on the apparatus main body, the developer cartridge comprising:

a casing having a first inner space serving as a developer accommodating chamber that accommodates a developer and a second inner space serving as a developing chamber in communication with the developer accommodating chamber;

an agitator disposed in the developer accommodating chamber and having a shaft portion that extends in an axial direction and that is rotatably supported in the casing, the agitator being rotatable about the shaft portion;

a developing roller disposed in the developing chamber and rotatably supported in the casing, wherein the casing is formed with a developer opening located at a position closer to the developing chamber than the shaft portion is, the casing including a pair of side walls that have shaft bearing portions for supporting both axial ends of the shaft portion, wherein the developer opening is formed in one of the pair of side walls, and a gear mechanism that transmits a driving force to the developing roller and the agitator is disposed on an outer surface of an other of the pair of side walls, located opposite to the one of the pair of side walls in which the developer opening is formed.

* * * * *